US007891117B2

(12) United States Patent
Sack

(10) Patent No.: US 7,891,117 B2
(45) Date of Patent: Feb. 22, 2011

(54) SANDAL CHARM CHAIN

(75) Inventor: Barbie Jo Sack, 12500 W. Cedar Dr., Lakewood, CO (US) 80228

(73) Assignee: Barbie Jo Sack, Lakewood, CO (US)

( * ) Notice: Subject to any disclaimer, the term of this patent is extended or adjusted under 35 U.S.C. 154(b) by 771 days.

(21) Appl. No.: 11/880,802

(22) Filed: Jul. 24, 2007

(65) Prior Publication Data

US 2009/0025259 A1 Jan. 29, 2009

(51) Int. Cl.
*A43B 3/12* (2006.01)

(52) U.S. Cl. ..... 36/11.5; 36/136; 36/1

(58) Field of Classification Search ..... 36/11.5, 36/136, 132, 1; 2/245; 63/1.11, 3, 3.1, 4, 63/9, 11, 21, 23, 40; 24/3.13, 298–302, DIG. 43
See application file for complete search history.

(56) References Cited

U.S. PATENT DOCUMENTS 1,535,646 A * 4/1925 Bostock ..... 36/45
1,616,215 A * 2/1927 Chilson ..... 63/5.2
1,640,104 A * 8/1927 Stafford et al. ..... 36/58.5
1,778,413 A * 10/1930 Ballou ..... 36/58.5
1,855,345 A * 4/1932 Fischer, Jr. ..... 36/58.5
4,026,047 A * 5/1977 Ahmer ..... 36/136
5,673,501 A * 10/1997 Mathews ..... 36/136
2006/0010573 A1* 1/2006 Habert ..... 2/237
2006/0260153 A1* 11/2006 White et al. ..... 36/136
2007/0062217 A1* 3/2007 Graham ..... 63/3
2007/0163146 A1* 7/2007 Brovkin ..... 36/7.6
2007/0266596 A1* 11/2007 Mann ..... 36/50.1
2008/0127525 A1* 6/2008 Blunden et al. ..... 36/136
2008/0276492 A1* 11/2008 Burnett ..... 36/51
2010/0058619 A1* 3/2010 Ferrante et al. ..... 36/136

* cited by examiner

*Primary Examiner*—Ted Kavanaugh

(57) ABSTRACT

The present invention in a first embodiment comprises a charm chain depending from two sandal adapted fasteners designed to be fastened on closed cell foam sandals either at pivots holding a strap onto the sandal or else at the periphery of the upper of the sandal. The fasteners may be elastic material in an annular shape such as a ring, a flower, or any other shape, with an aperture therethrough or similar designs. In embodiments, the fasteners may be clips adapted to hold between their jaws the thickness of closed cell foam typically found in such sandal uppers, this same thickness usually being present on the strap as well so that the invention clips may attach there as well if desired. In other embodiments, a single fastener is suspended at a single location and a charm in turn depends from the fastener, possibly including a clip.

4 Claims, 16 Drawing Sheets

SANDAL CHARM CHAIN

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

CROSS-REFERENCE TO RELATED APPLICATIONS

N/A

FIELD OF THE INVENTION

This invention relates generally to footwear, and specifically to accessories for modern sandal footwear.

STATEMENT REGARDING FEDERALLY FUNDED RESEARCH

This invention was not made under contract with an agency of the US Government, nor by any agency of the US Government.

BACKGROUND OF THE INVENTION

The recent popularity of closed cell foam sandals such as those sold under the trade name CROCS® brand sandals has allowed the use of footwear in new ways not previously possible.

In particular, sentimental and ornamental accessories to such sandals are now possible. One notable example is JIBBITZ® brand accessories, which are small button style devices having a first ornamental portion and a second portion passing through a hole in the material of the sandal upper.

FIG. 1 shows a typical PRIOR ART foam sandal. Several features are of interest. Firstly, the sandal has numerous small holes through which JIBBITZ® brand accessories have been placed. Secondly, the device has a strap attached to the sandal at both ends by strap pivots, large rotating grommets which allow the soft foam strap to move from a forward position at the sandal upper to a position near the rear of the heel portion. Thirdly, the material of the upper portion (colloquially known as the "upper" in the footwear industry) is a soft closed cell polymer foam having a definite thickness in excess of 5 millimeters.

Charm bracelets have been known in the past as well. However, charm bracelets have not been used on footwear previously. The closed cell foam sandal with uppers and pivots is a recent invention which opens up new possibilities.

It would be advantageous to provide a sandal having charms thereon.

It would further be advantageous to provide a sandal charm chain which can be detached from a sandal.

It would further be advantageous to provide a sandal charm chain which would allow addition of charms selected by the user.

SUMMARY OF THE INVENTION

General Summary

The present invention in a first embodiment comprises a charm chain depending from two sandal adapted fasteners designed to be fastened on closed cell foam sandals either at pivots holding a strap onto the sandal or else at the periphery of the upper of the sandal.

The fasteners may be elastic material in an annular shape such as a ring, a flower with an aperture therethrough or similar designs. In other embodiments, the fasteners may be clips adapted to hold between their jaws the thickness of closed cell foam typically found in such sandal uppers, this same thickness usually being present on the strap as well so that the invention clips may attach there as well if desired. Such a clip may hold the device by itself, without pivot adapted retainers, or the clip may be in a middle part of the chain in order to stabilize the chain.

In other embodiments, a single fastener is suspended at a single location and a charm in turn depends from the fastener.

SUMMARY IN REFERENCE TO CLAIMS

It is therefore another aspect, advantage, objective and embodiment of the invention, in addition to those discussed previously, to provide a sandal comprising:

a body portion;

a upper of the body portion, the upper having a thickness;

a strap attached to the body portion at first and second locations by first and second pivots, the first and second pivots having first and second circumferences;

first and second sandal adapted fasteners;

a first charm chain, the first charm chain having an attractive appearance, the first charm chain having the first sandal adapted fastener at a first location and having the second sandal adapted fastener at a second location; the first charm chain having a first length, the first length being sufficient for the first charm chain to stretch across the upper and lie thereon with the first sandal adapted fastener attached at the first pivot and the second sandal adapted fastener attached at the second pivot.

It is therefore another aspect, advantage, objective and embodiment of the invention to provide a sandal, wherein the first and second sandal adapted fasteners further comprise:

an annular body, the annular body having a circumference slightly smaller than the first circumference, the annular body made of a polymer material having elastic properties, whereby the sandal adapted fasteners are adapted to attach at the pivot.

It is therefore another aspect, advantage, objective and embodiment of the invention to provide a sandal, wherein the first sandal adapted pivot fastener further comprises:

an outer periphery in the form of a flower.

It is therefore another aspect, advantage, objective and embodiment of the invention to provide a sandal, further comprising:

a second length of charm chain attached to and depending from the first charm chain, a charm attached to and depending from the second length of charm chain.

It is therefore another aspect, advantage, objective and embodiment of the invention to provide a sandal, wherein the first and second sandal adapted fasteners further comprise:

clip bodies, the clip bodies adapted to secure to the thickness of the upper.

It is therefore another aspect, advantage, objective and embodiment of the invention to provide a sandal accessory for use on sandals having a upper having a thickness and a strap attached to the body portion at first and second locations by first and second pivots, the first and second pivots having first and second circumferences; the sandal accessory comprising:

first and second sandal adapted fasteners;

a first charm chain, the first charm chain having an attractive appearance, the first charm chain having the first sandal adapted fastener at a first location and having the second sandal adapted fastener at a second location; the first charm chain having a first length, the first length being sufficient for the first charm chain to stretch across such upper and lie thereon with the first sandal adapted fastener attached at such first pivot and the second sandal adapted fastener attached at such second pivot.

It is therefore another aspect, advantage, objective and embodiment of the invention to provide a sandal accessory, wherein the first and second sandal adapted fasteners further comprise: an annular body, the annular body having a circumference slightly smaller than such first circumference, the annular body made of a polymer material having elastic properties, whereby the sandal adapted fasteners are adapted to attach at such pivot.

It is therefore another aspect, advantage, objective and embodiment of the invention to provide a sandal accessory, wherein the first sandal adapted pivot fastener further comprises:

an outer periphery in the form of a flower.

It is therefore another aspect, advantage, objective and embodiment of the invention to provide a sandal accessory further comprising:

a second length of charm chain attached to and depending from the first charm chain, a charm attached to and depending from the second length of charm chain.

It is therefore another aspect, advantage, objective and embodiment of the invention to provide a sandal accessory, wherein the first and second sandal adapted fasteners further comprise:

clip bodies, the clip bodies adapted to secure to such thickness of such upper.

It is therefore another aspect, advantage, objective and embodiment of the invention to provide a charm, for use on sandals having a upper having a thickness and a strap attached to the body portion at first and second locations by first and second pivots, the first and second pivots having first and second circumferences, the charm comprising:

a sandal adapted fastener;

a charm chain having an attractive appearance, the charm chain having the sandal adapted fastener at a first location; and a charm depending from the charm chain.

It is therefore another aspect, advantage, objective and embodiment of the invention to provide a charm, the annular body having a circumference slightly smaller than such first circumference, the annular body made of a polymer material having elastic properties, whereby the sandal adapted fastener is adapted to attach at such pivot.

It is therefore another aspect, advantage, objective and embodiment of the invention to provide a charm, wherein the sandal adapted pivot fastener further comprises:

an outer periphery in the form of a flower.

It is therefore another aspect, advantage, objective and embodiment of the invention to provide a charm, wherein the sandal adapted fastener further comprises:

a clip body, the clip body adapted to secure to such thickness of such upper.

INDEX OF THE REFERENCE NUMERALS

Figure 1:
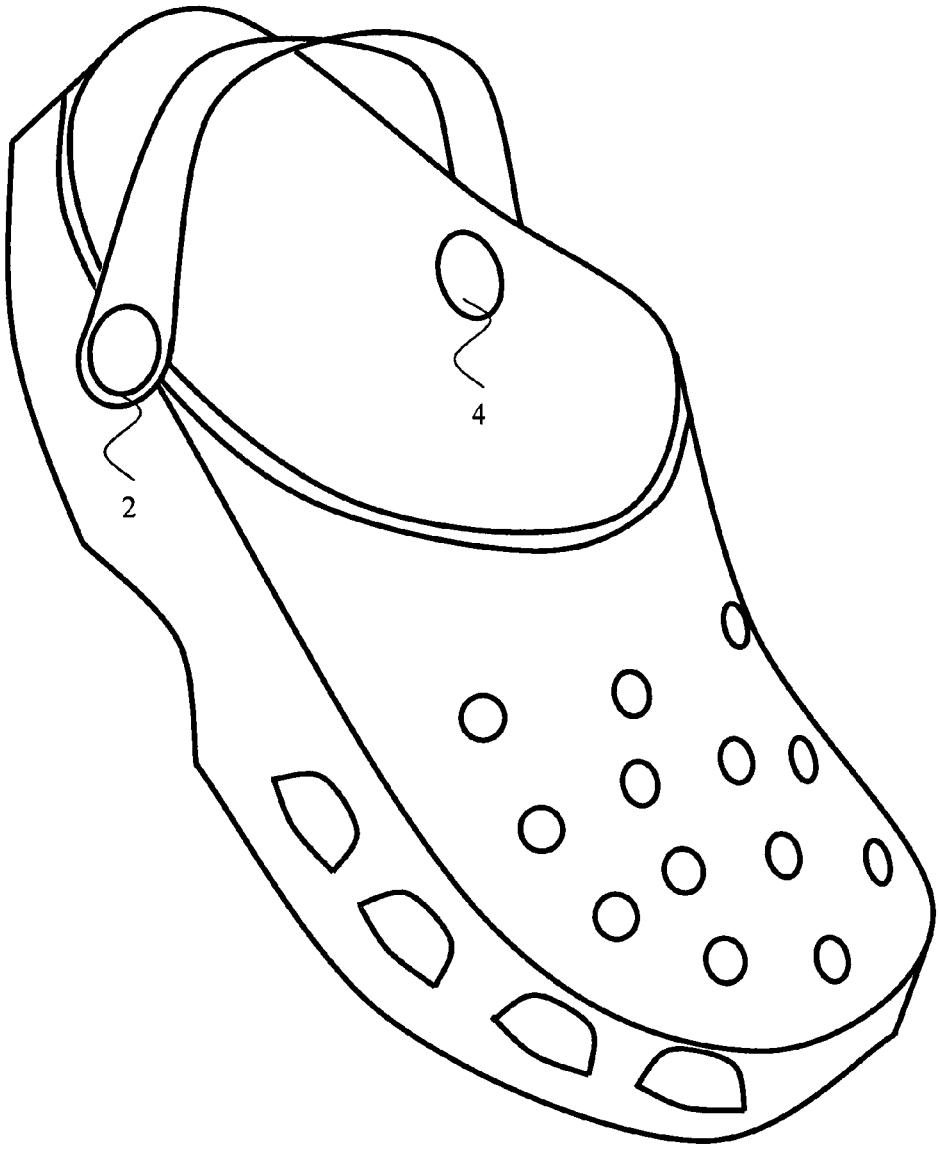
Fig. 1 Prior Art
FIG. 1 is a perspective side-front elevational view of a PRIOR ART sandal.

Pivot 2
Pivot 4
Sandal pivot adapted fastener 22
Charm chain 24
Sandal pivot adapted fastener 26
Sandal pivot adapted fastener 32
Charm chain 34
Ornamental pivot fastener 42
Charm chain 44
Ornamental pivot fastener 46
Ornamental pivot fastener 52
Charm chain 54
Ornamental pivot fastener 62
Charm chain 64
Charm 66
Ornamental pivot fastener 72
Charm chain 74
Charm 76
Sandal upper clip 82
Charm chain 84
Charm 86
Sandal upper clip 91
Charm chain 92
Charm 93
Sandal upper clip 94
Charm chain 95
Charm 96
Sandal upper clip 97
Charm chain 98
Charm 99
Sandal upper clip 102
Sandal upper clip 104
Charm chain 106
Sandal upper clip 108
Sandal pivot adapted fastener 111
Charm chain 112

Charm chain 113
Charm 114
Charm chain 115
Charm 116
Charm chain 117
Charm 118
Sandal pivot adapted fastener 119
Charm chain 121
Charm chain 122
Charm 123
Sandal pivot adapted fastener 124
Charm chain 125
Charm 126
Sandal pivot adapted fastener 132
Charm chain 134
Sandal upper clip 136
Sandal pivot adapted fastener 138
Sandal upper clip 142
Charm chain 144
Sandal pivot adapted fastener 146
Sandal pivot adapted fastener 152
Charm chain 154
Sandal upper clip 156
Sandal pivot adapted fastener 158
Sandal upper clip 162
Charm chain 164
Sandal pivot adapted fastener 166

DETAILED DESCRIPTION

FIG. 1 is a perspective side-front elevational view of a PRIOR ART sandal. It may be seen that these popular sandals have pivots, such as pivot 2 and pivot 4 which attach the strap portion to the body portion of the sandal. The body portion in turn has an upper, which is made of the closed cell foam material of the sandal and has a visible thickness. The material is not limited to closed cell foam, it may be other foams, polymers, natural fabrics and leathers, composites, fabrics and combinations thereof.

Figure 2:
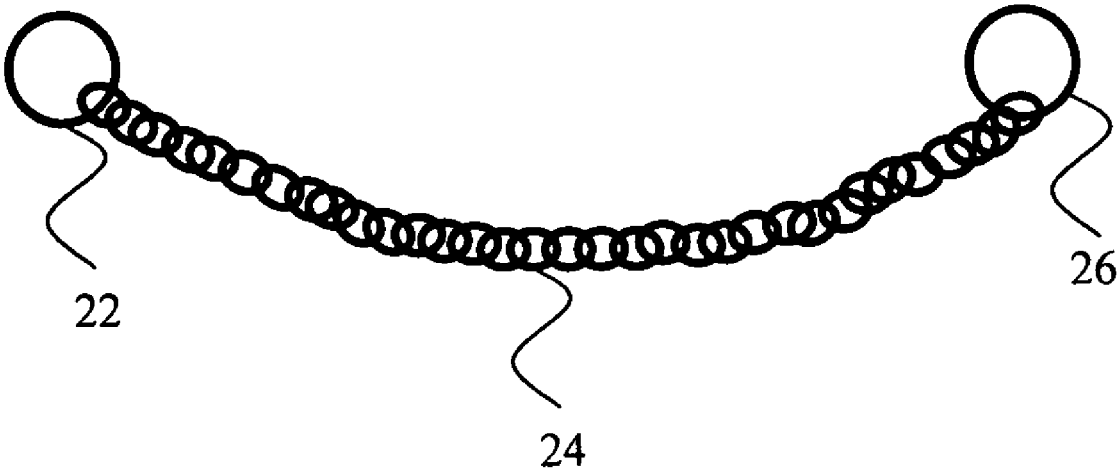
FIG. 2 is a front view of a first charm chain embodiment of the invention.

FIG. 2 is a front view of a first charm chain embodiment of the invention. Sandal pivot adapted fastener 22 is located at a first location of charm chain 24 while sandal pivot adapted fastener 26 is located at a second location of the chain 24. The chain 24 is not the type of chain adapted for traction devices such as footwear traction or vehicle tire traction, nor for pulling or the like. The charm chain has an attractive appearance and links large enough to allow attachment of charms which may then depend from the chain.

The charm chain of the invention is attached at the sandal at the lip of the upper, or at the pivot of the sandal, "attached at" meaning either attached to pivot or attached to upper or strap at the location of the pivot. The chain may be stabilized with a metal clip attached to the shoe lip. This presents the chain from bouncing off the shoe when the user is walking or running. The chain clip can also be used as the primary attachment point, suspending the chain from the shoe lip without using strap buttons to secure the ends at all, or without ends at all.

Figure 3:
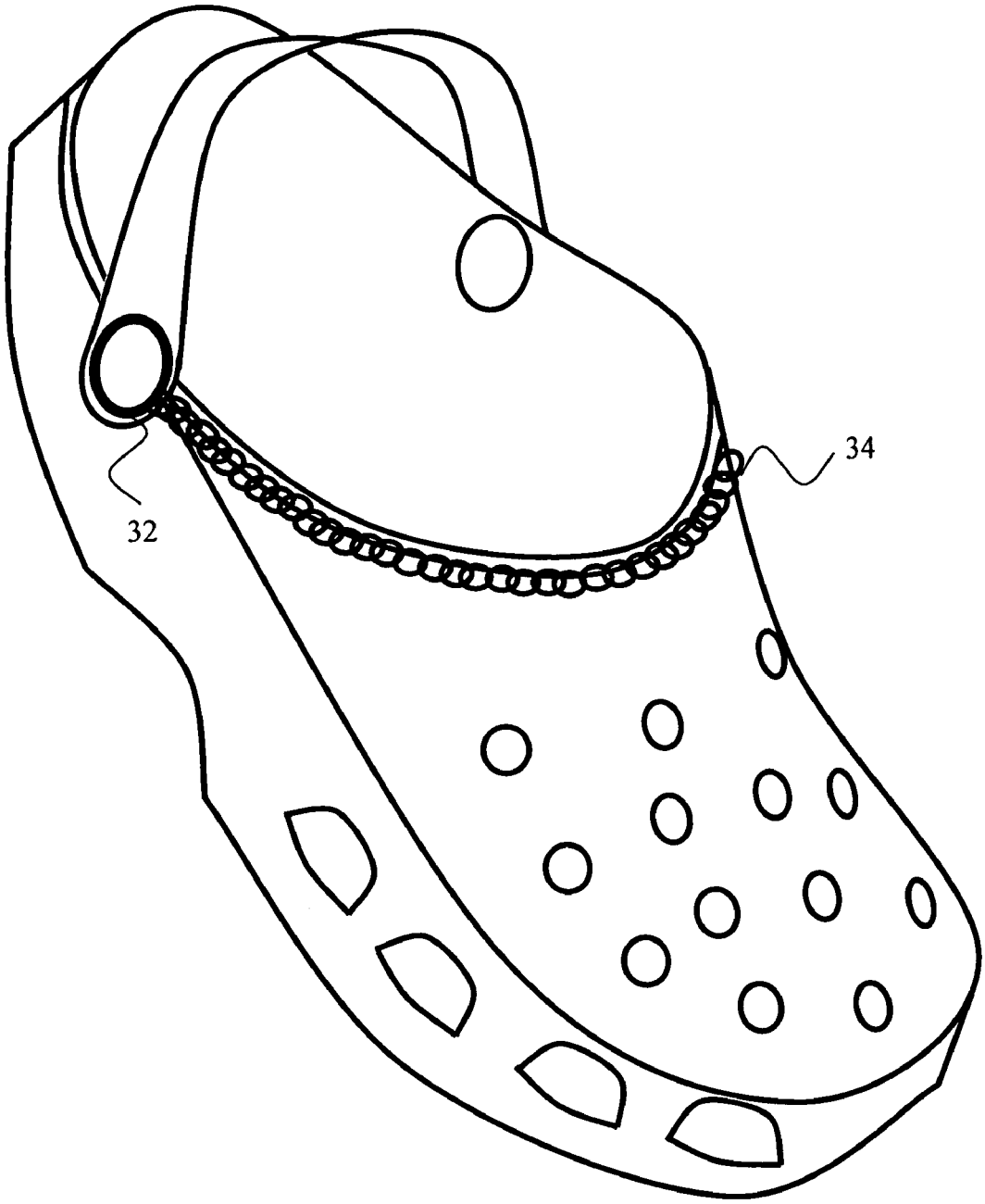
FIG. 3 is a perspective side-front elevational view of a second charm chain sandal embodiment of the invention.

FIG. 3 is a perspective side-front elevational view of a second charm chain sandal embodiment of the invention in use on a sandal. Sandal pivot adapted fastener 32 has been attached to the pivot in a removable manner, and charm chain 34 is suspended therefrom.

Note that the pivots have a circumference and shape and that the pivot adapted fastener is dimensioned and configured to attach to the pivot, regardless of the shape and size of the pivot. On other similar sandals in which the pivot does not actually serve any pivot function then the invention fastener may be adapted to the size and shape of the pivot.

Polymers having high elasticity are preferred for the invention. Clear, transparent and translucent polymers have been used in testing, as well as colorful polymers. Polymers of both the "rubber" type and the "plastic" type have been used.

Figure 4:
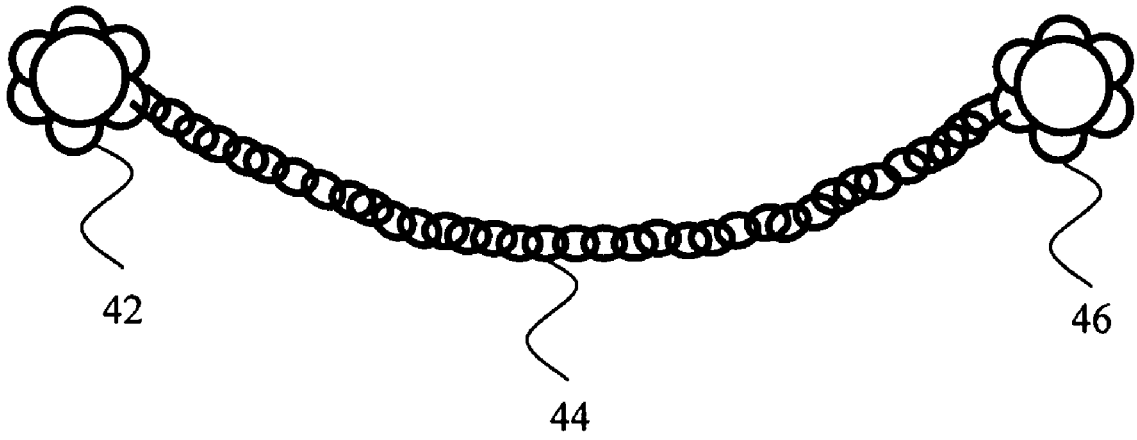
FIG. 4 is a front view of a third charm chain embodiment of the invention.
Figure 5:
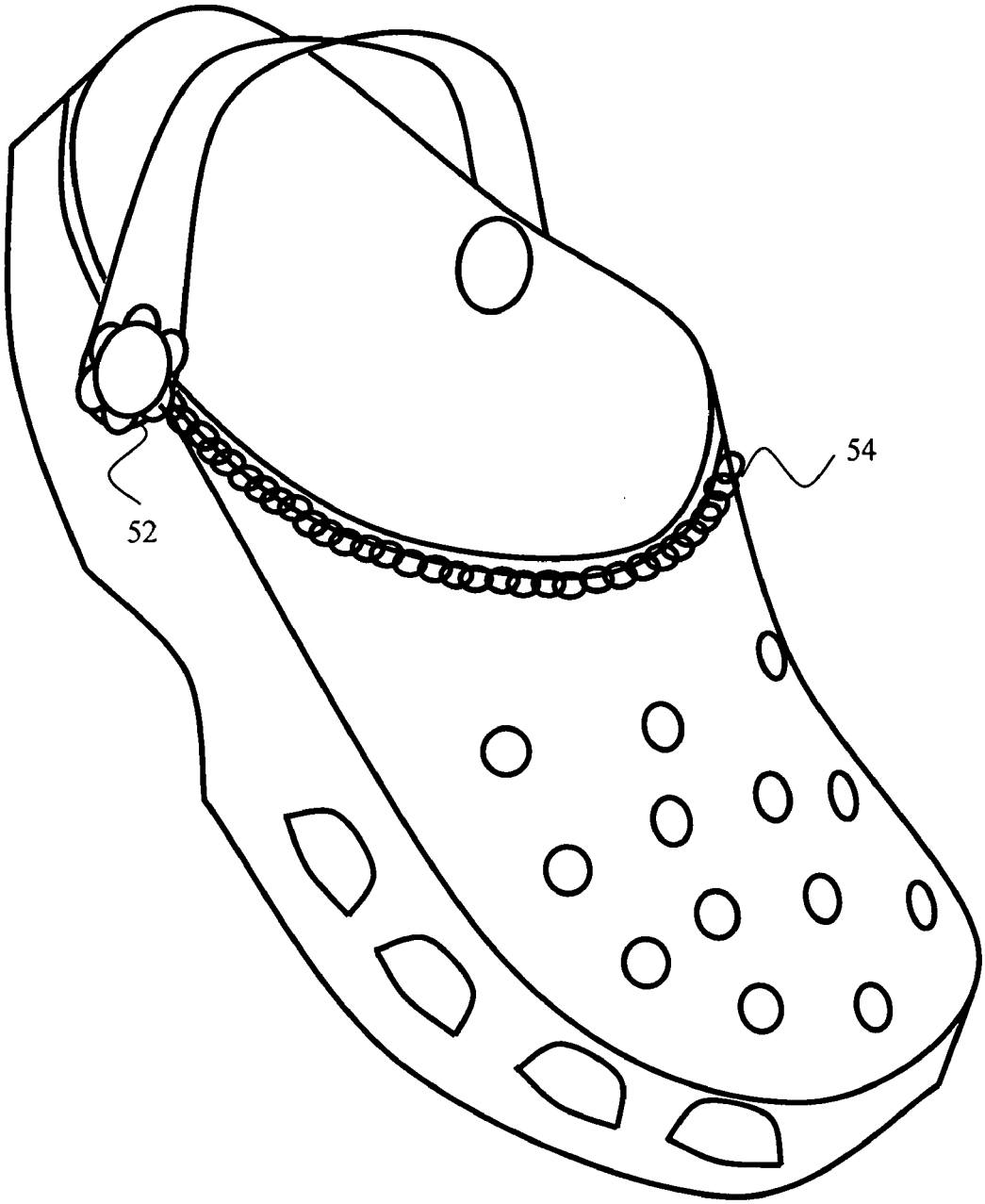
FIG. 5 is a perspective side-front elevational view of a fourth charm chain sandal embodiment of the invention.

FIG. 4 is a front view of a third charm chain embodiment of the invention. In this embodiment, the pivot adapted fastener has an ornamental appearance. Ornamental pivot fastener 42 has a periphery in the shape of a flower, though the flower may be a star shape, a geometrical shape, a face and other ornamental patterns. Charm chain 44 depends therefrom as well as from ornamental pivot fastener 46, and FIG. 5 is a perspective side-front elevational view of a fourth charm chain sandal embodiment of the invention in use on a sandal, showing ornamental pivot fastener 52 and charm chain 54.

It will be understood that the diagrams may depict either the charm chain embodiment of the invention as described or may depict an entire sandal embodiment of the invention. In either case, the charm chain lies upon the upper of the sandal and stretches across the upper from pivot to pivot.

Figure 6:
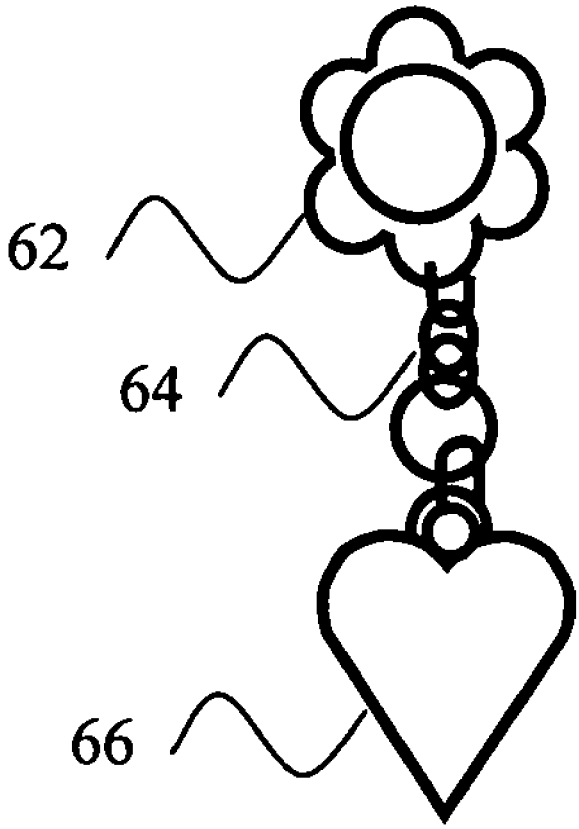
FIG. 6 is a front view of a fifth sandal charm embodiment of the invention.

FIG. 6 on the other hand is a front view of a fifth sandal charm embodiment of the invention. The ornamental pivot fastener 62 is a single fastener instead of one of a pair, and charm chain 64 may hang straight down therefrom instead of across the upper of the sandal. Charm 66 in turn depends from the chain 64, or the chain 64 may be dispensed with and the charm 66 may depend directly from the fastener 62.

It may be seen that a lobster claw clip, another type of clip, a quick release clip and the like may be used in the device chain suspension system. For example the charm may be suspended from the "lobster claw" or other clip, or the clip may be at an intermediate position in the chain, as depicted. The clip may be metal, polymer, fabric, composites and combinations thereof.

Figure 7:
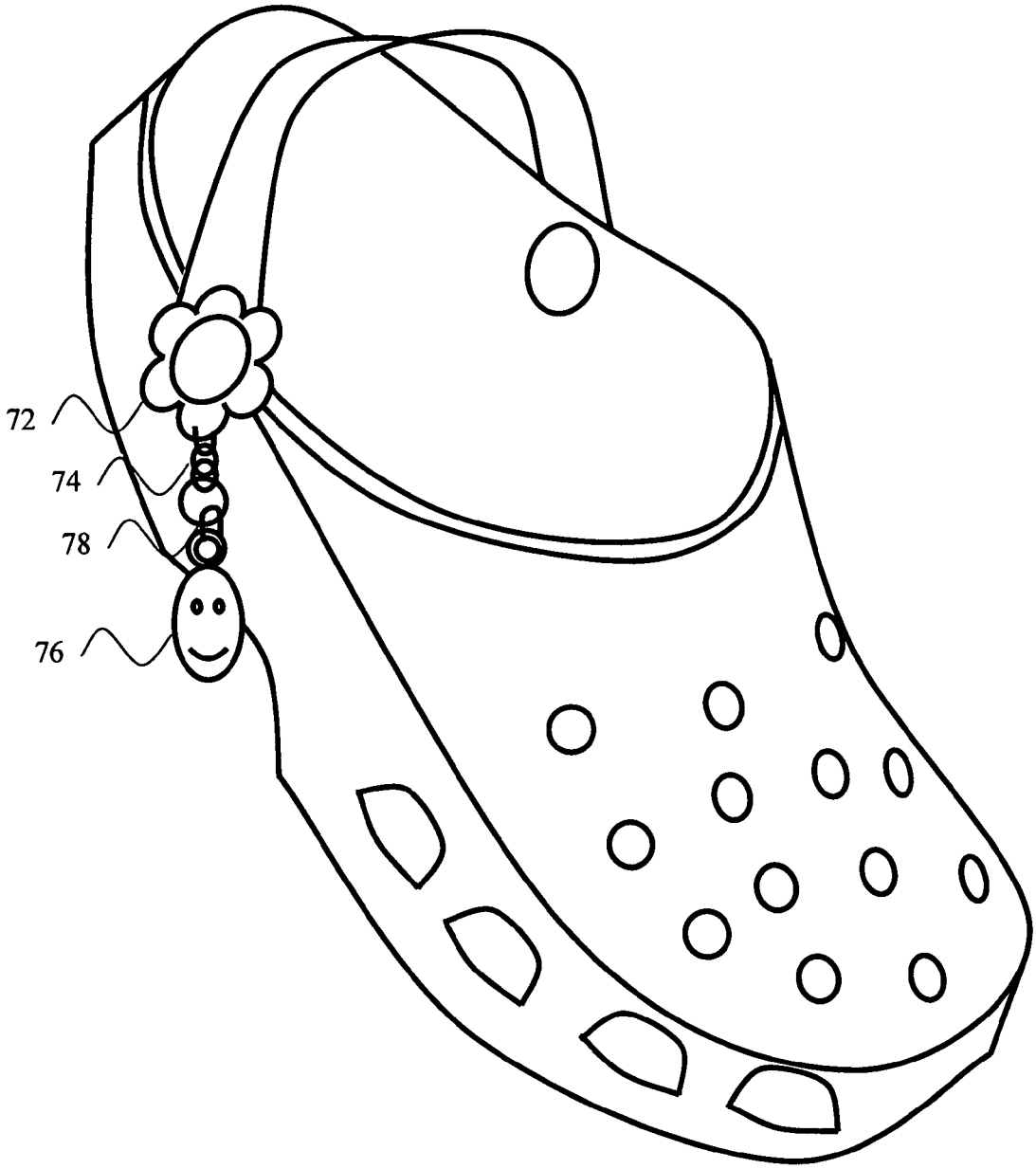
FIG. 7 is a perspective side-front elevational view of a sixth charm chain sandal embodiment of the invention.

FIG. 7 is a perspective side-front elevational view of a sixth charm chain sandal embodiment of the invention in use on a sandal, with ornamental pivot fastener 72 holding charm chain 74 which holds charm 76. A wide variety of charms may be seen in use: lightening bolts, flowers, faces, stars, scrolls or banners with wording or indicia thereon, moons and crescents, peace symbols, icons, letters, numbers, trademarks and so on.

Figure 8:
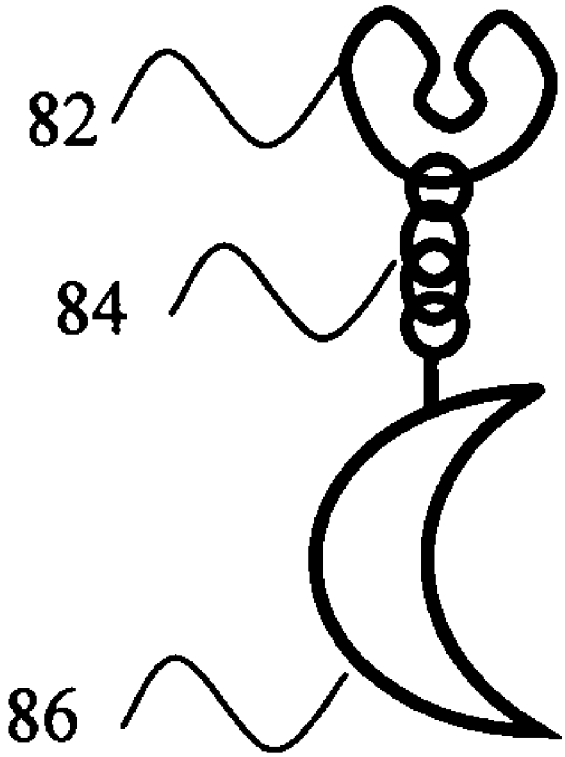
FIG. 8 is a front view of a seventh sandal charm embodiment of the invention.

FIG. 8 is a front view of a seventh sandal charm embodiment of the invention. In this embodiment, the fastener is a clip, sandal upper adapted clip 82 having jaws with a spacing in between which will be grip firmly the thickness of a sandal upper. Charm chain 84 and charm 86 may be much as previously described. Wire is a suitable material for the clip, as is relatively stiff polymer, alligator clips or other spring loaded clips, metal and so on.

Figure 9:
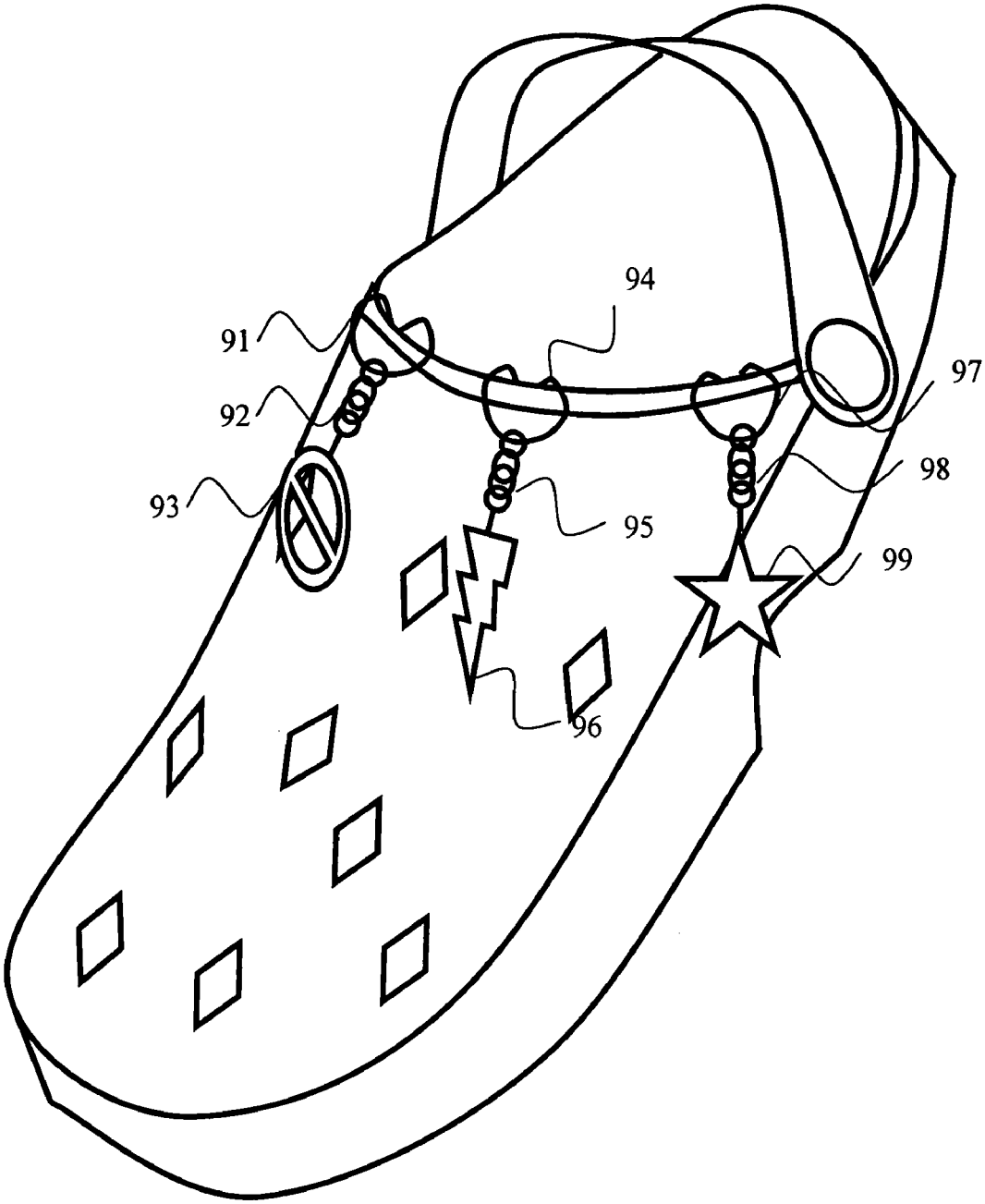
FIG. 9 is a perspective front elevational view of an eighth charm sandal embodiment of the invention.

FIG. 9 is a perspective front elevational view of an eighth charm sandal embodiment of the invention in use, showing several possible charm types in use on a single sandal. Note that the sandal may have a slightly different configuration of upper or shape, but it will nonetheless support sandal upper clip 91 having charm chain 92 and charm 93. Additional charms such as sandal upper clip 94/charm chain 95/charm 96 and the combination of sandal upper clip 97 and harm chain 98 with star charm 99 may be used, and may depend from most parts of the upper, from the strap and so on.

Figure 10:
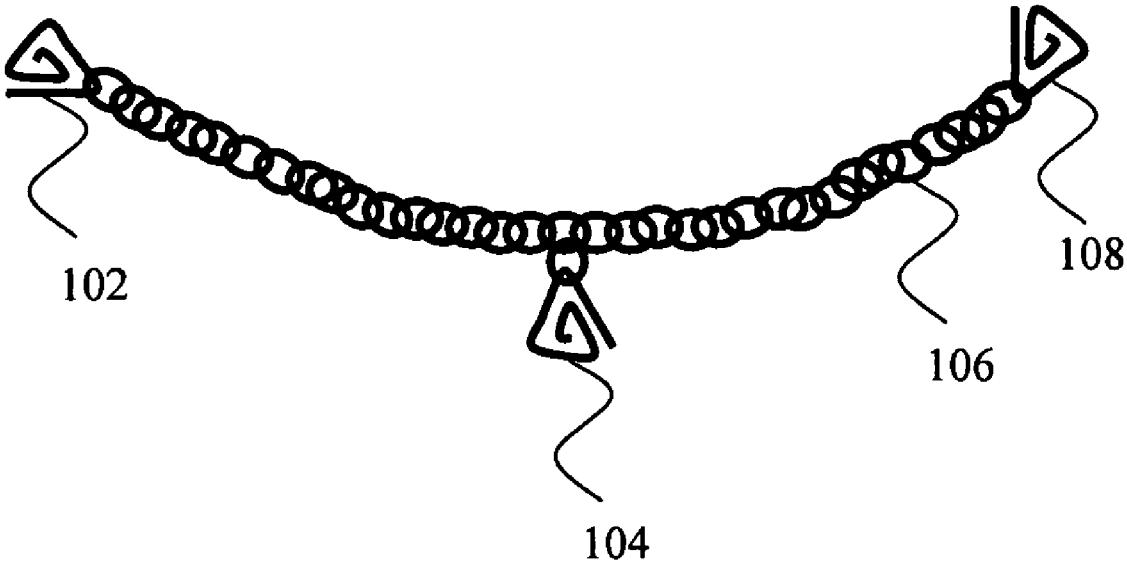
FIG. 10 is a front view of a ninth charm chain embodiment of the invention.

FIG. 10 is a front view of a ninth charm chain embodiment of the invention. Sandal upper clip 102 and sandal upper clip 104 and sandal upper clip 108 may be used in combination: more than two fasteners may thus be used, and the annular type fastener and the clip type fastener may even be combined on a single charm chain 106.

Figure 11:
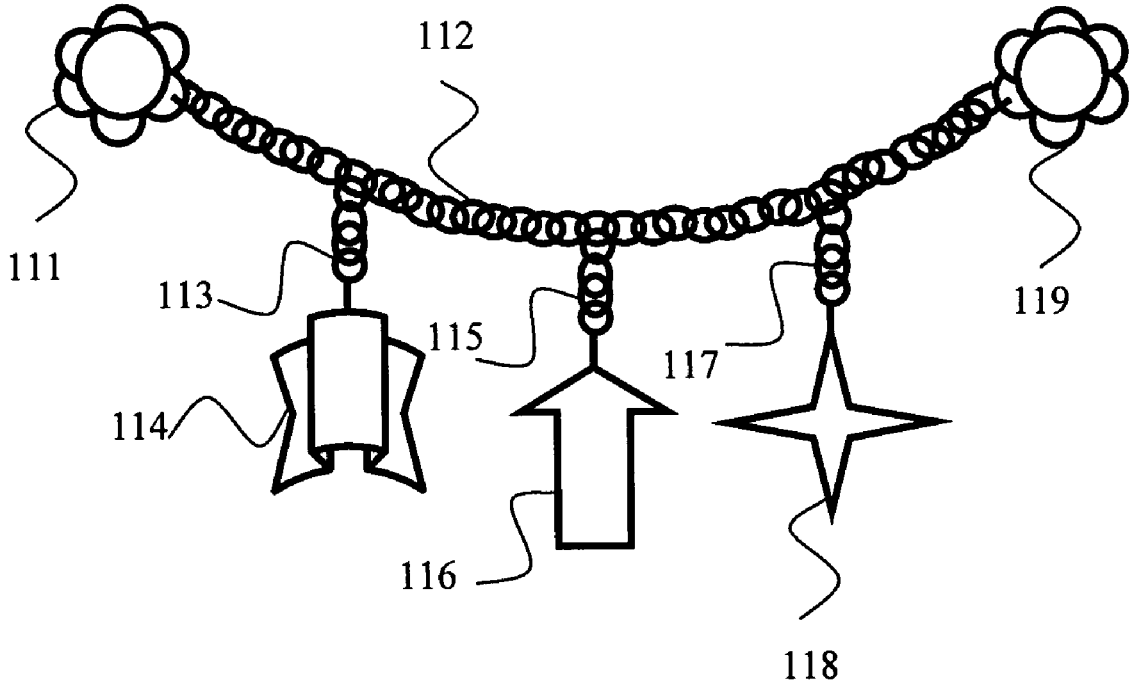
FIG. 11 is a front view of a tenth charm chain embodiment of the invention.

FIG. 11 is a front view of a tenth charm chain embodiment of the invention, showing Sandal pivot adapted fasteners 111 and 119 holding suspended therebetween a primary charm chain 112, which in turn supports charm chains 113, 115, and 117, which themselves in turn support charms 114, 116 and 118.

Figure 12:
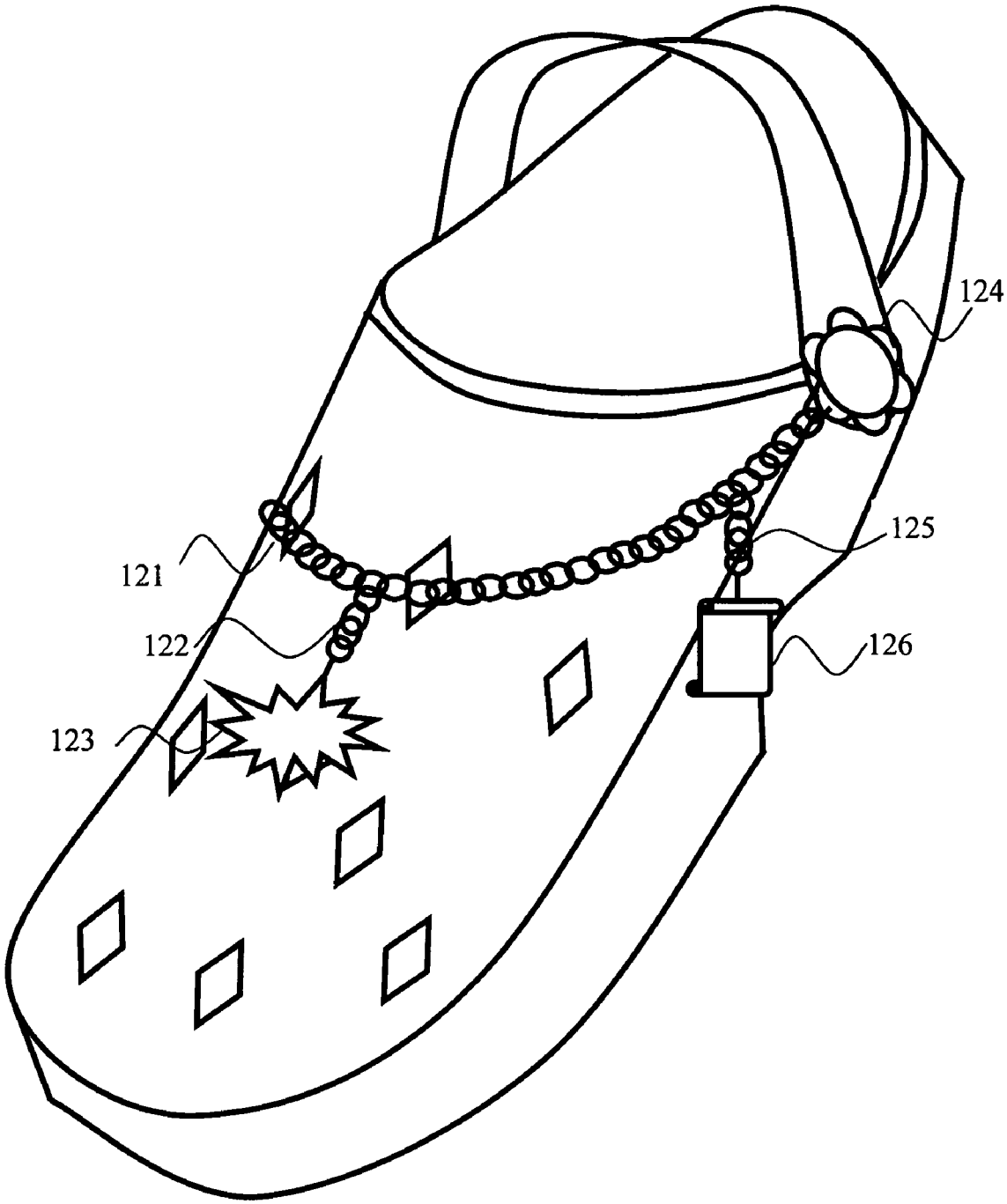
FIG. 12 is a perspective front elevational view of an eleventh charm chain sandal embodiment of the invention.

FIG. 12 is a perspective front elevational view of an eleventh charm chain sandal embodiment of the invention. Due to a different shape of the upper of a different sandal, or a different length of chain, the charm chain 121 lies thereon at a different angle than (for example) the embodiment shown in FIG. 3. However, the length of the chain is sufficient to pass across the top of the shoe, the upper, rather than being sized for passing below the shoe, around the show or the like. Charm chains 122 and 125 support charms 123 and 126.

Figure 13:
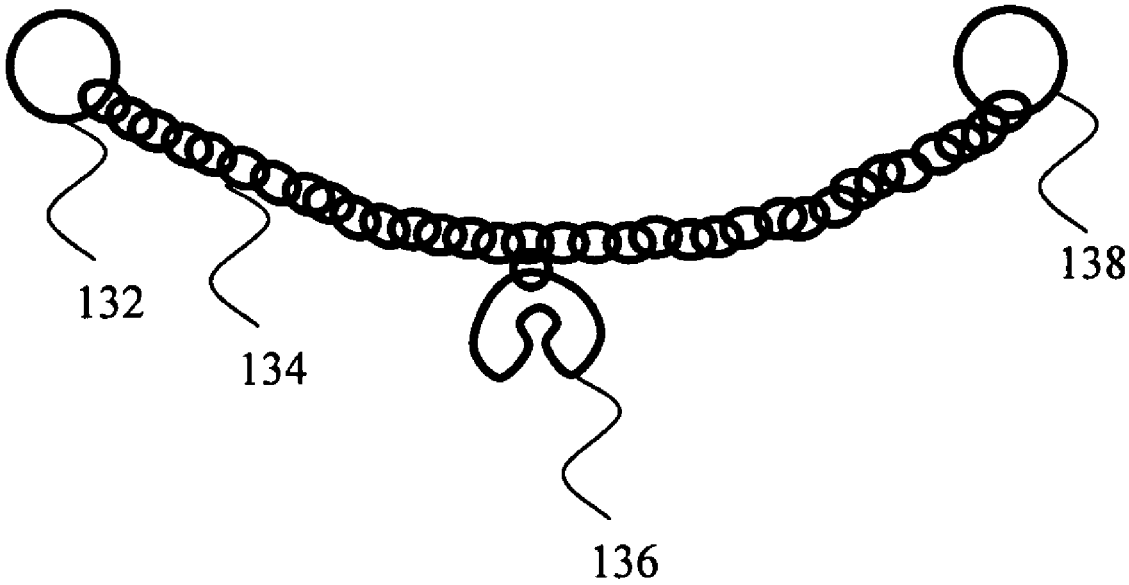
FIG. 13 is a front view of a twelfth charm chain embodiment of the invention.

FIG. 13 is a front view of a twelfth charm chain embodiment of the invention. Sandal pivot adapted fastener 132 and charm chain 134, and sandal pivot adapted fastener 138 are as previously described (with circular pivot adapted fasteners), but with the addition of a sandal upper clip 136 adapted to the sandal upper lip.

Figure 14:
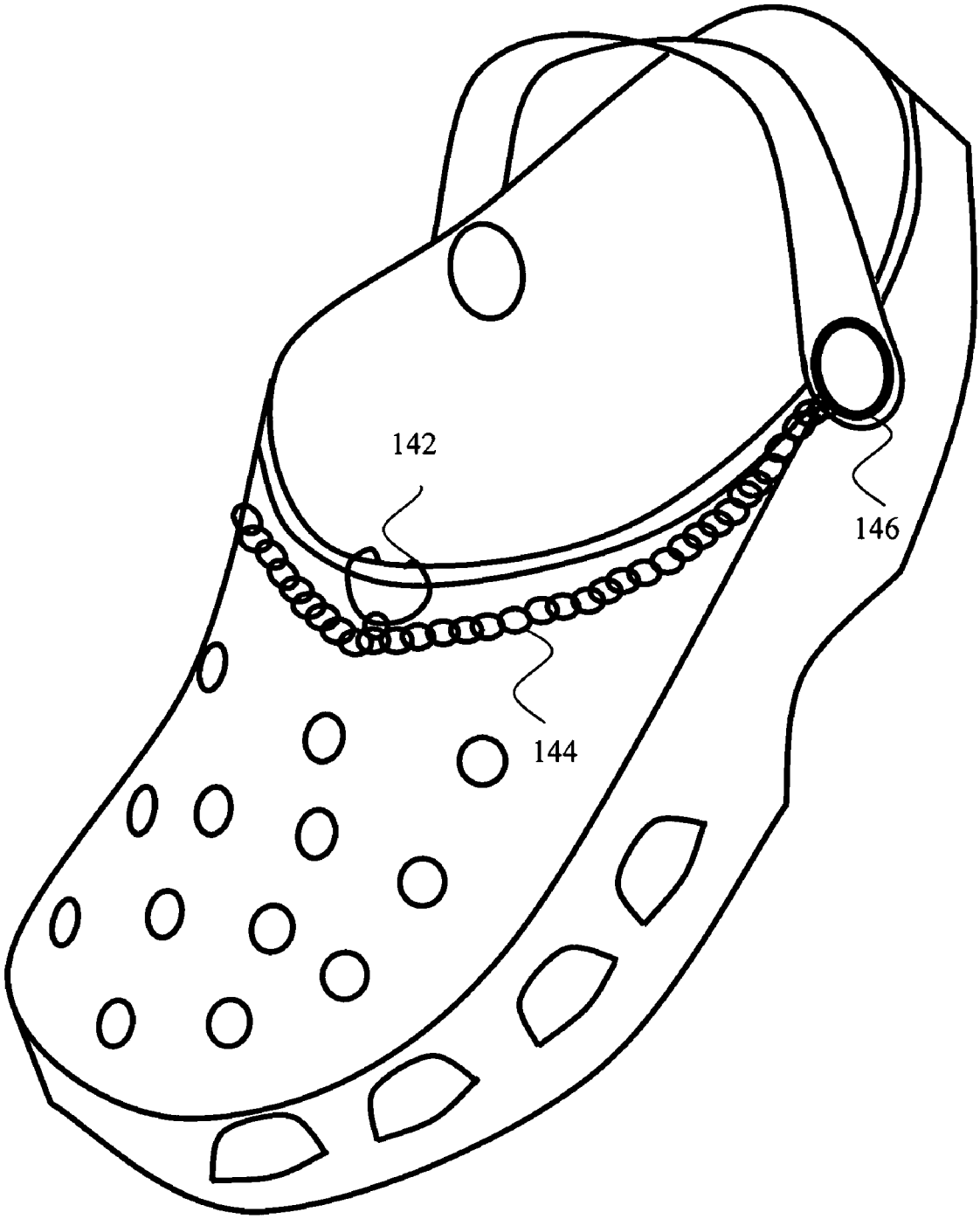
FIG. 14 is a perspective front elevational view of a thirteenth charm chain sandal embodiment of the invention.

FIG. 14 is a perspective front elevational view of a thirteenth charm chain sandal embodiment of the invention. It will be noted that the sandal may be any of a variety of shapes, as such foam sandals may be.

Sandal upper clip 142 is situated at the lip in order to provide the charm chain 144 with stability beyond that from sandal pivot adapted fastener 146.

Figure 15:
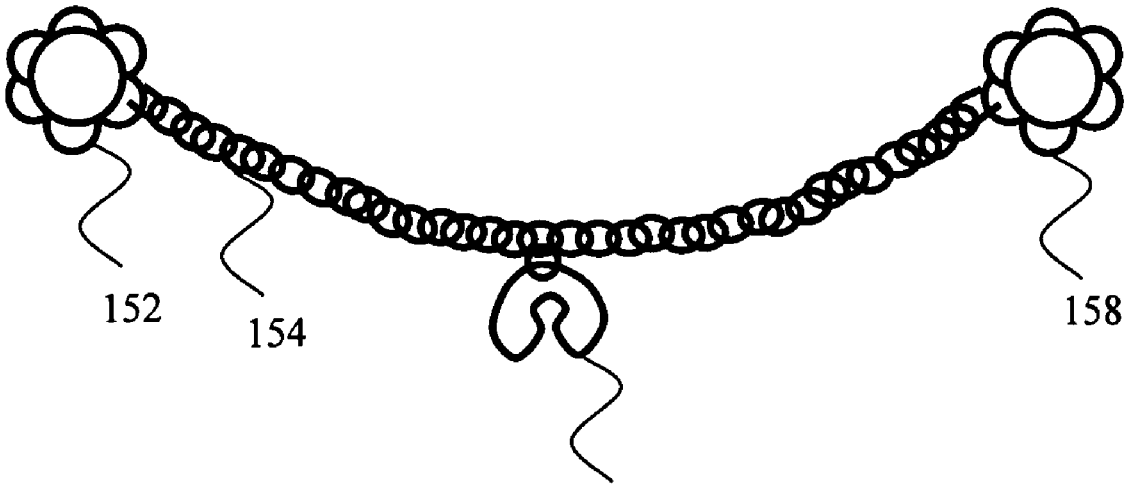
FIG. 15 is a front view of a fourteenth charm chain embodiment of the invention.

FIG. 15 is a front view of a fourteenth charm chain embodiment of the invention. Sandal pivot adapted fasteners 152, 158 are as noted previously, as is charm chain 154. Sandal upper clip 156 stabilizes the device when the user is walking or running.

Figure 16:
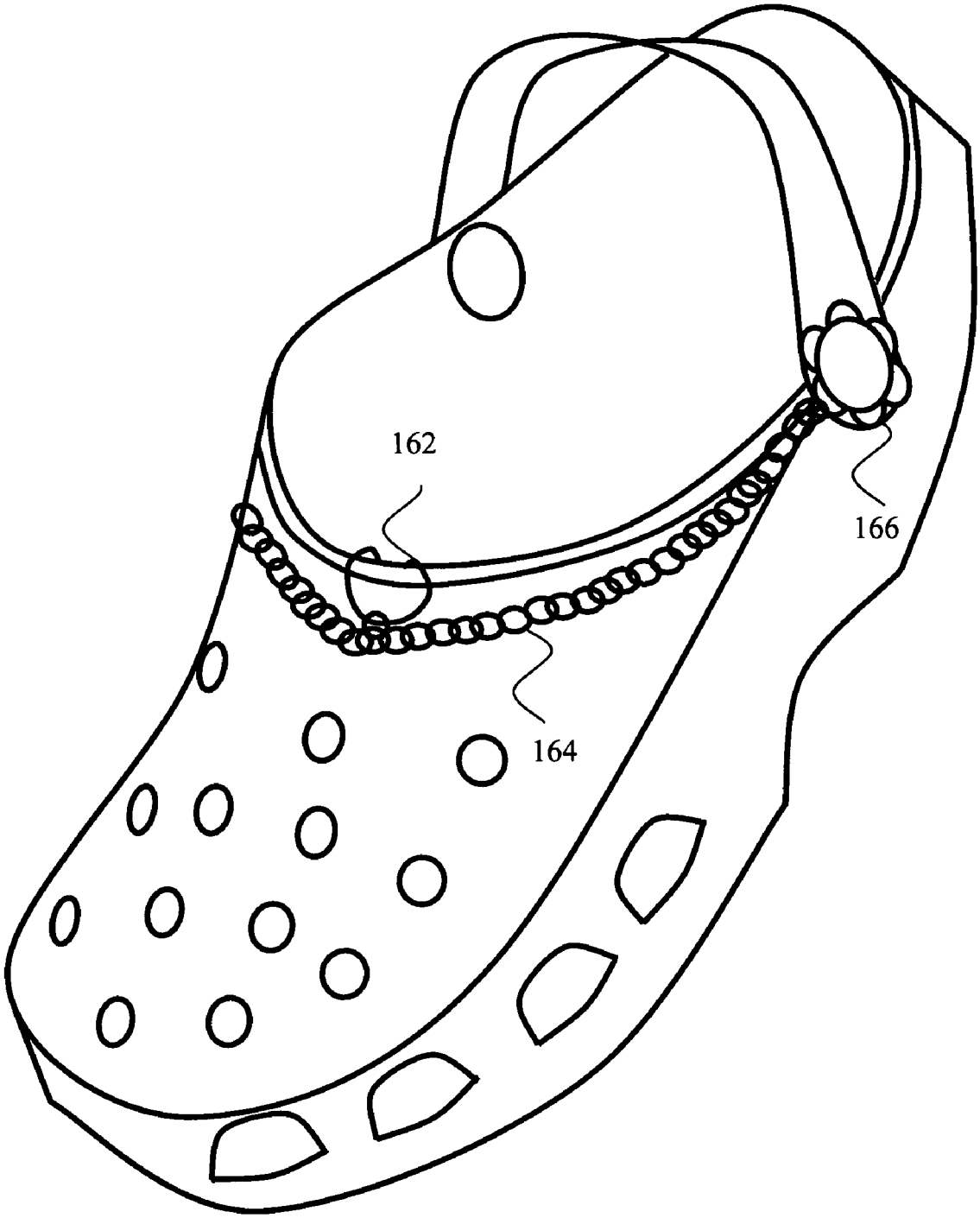
FIG. 16 is a perspective front elevational view of a fifteenth charm chain sandal embodiment of the invention.

FIG. 16 is a perspective front elevational view of a fifteenth charm chain sandal embodiment of the invention. Sandal upper clip 162 and charm chain 164 and sandal pivot adapted fastener 166 (a second fastener is not seen) provide three points or more of suspension and stability.

In the presently preferred embodiment and best mode presently contemplated for carrying out the invention, the chain is metallic and thus strong enough to support the charms against occasional snags, however, in embodiments the chains may be polymer as well, or even fabric or the like.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. A sandal comprising:

a body portion;

a upper of the body portion, the upper having a thickness;

a strap attached to the body portion at first and second locations by first and second pivots, the first and second pivots having first and second circumferences;

first and second sandal adapted fasteners;

a first charm chain, the first charm chain having an attractive appearance, the first charm chain having the first sandal adapted fastener at a first location and having the second sandal adapted fastener at a second location; the first charm chain having a first length, the first length being sufficient for the first charm chain to stretch across the upper and lie thereon with the first sandal adapted fastener attached at the first pivot and the second sandal adapted fastener attached at the second pivot wherein the first and second sandal adapted fasteners further comprise: an annular body, the annular body having a circumference slightly smaller than the first circumference, the annular body made of a polymer material having elastic properties, whereby the sandal adapted fasteners are adapted to attach around the pivot.

2. The sandal of claim 1, wherein the first sandal adapted pivot fastener further comprises:

an outer periphery in the form of a flower.

3. The sandal of claim 1, further comprising:

a second length of charm chain attached to and depending from the first charm chain, a charm attached to and depending from the second length of charm chain.

4. The sandal of claim 1, wherein the first and second sandal adapted fasteners further comprise:

clip bodies, the clip bodies adapted to secure to the thickness of the upper.

* * * * *